US007143470B2

(12) United States Patent
Bosses

(10) Patent No.: US 7,143,470 B2
(45) **Date of Patent: *Dec. 5, 2006**

(54) VACUUM CLEANER NOZZLE INCLUDING MECHANICAL BEATER AND SONIC BEATER

(75) Inventor: Mark D. Bosses, 505 NE. Spanish Trail, Boca Raton, FL (US) 33432

(73) Assignee: Mark D. Bosses, Boca Raton, FL (US)

( * ) Notice: Subject to any disclaimer, the term of this patent is extended or adjusted under 35 U.S.C. 154(b) by 31 days.

This patent is subject to a terminal disclaimer.

(21) Appl. No.: 11/035,804

(22) Filed: Jan. 10, 2005

(65) Prior Publication Data

US 2005/0278891 A1 Dec. 22, 2005

Related U.S. Application Data

(63) Continuation-in-part of application No. 10/871,461, filed on Jun. 18, 2004.

(51) Int. Cl.
*A47L 9/04* (2006.01)

(52) U.S. Cl. ..... 15/364; 15/382

(58) Field of Classification Search ..... 15/364, 15/382, 404

See application file for complete search history.

(56) References Cited

U.S. PATENT DOCUMENTS

| | | | | |
|---|---|---|---|---|
| 1,792,992 | A * | 2/1931 | Lerch | 15/382 |
| 1,970,355 | A * | 8/1934 | Bennett | 15/364 |
| 2,251,562 | A * | 8/1941 | Belpedio | 15/364 |
| 2,253,309 | A * | 8/1941 | Smellie | 15/364 |
| 2,581,794 | A * | 1/1952 | Francis | 15/364 |
| 2,825,925 | A | 3/1958 | Acheson | |
| 2,932,054 | A | 4/1960 | Lichtgarn | |
| 3,071,145 | A | 1/1963 | Blanchard | |
| 3,364,627 | A * | 1/1968 | Wright | 451/350 |
| 3,750,221 | A | 8/1973 | Meyerhoefer | |
| 4,223,417 | A | 9/1980 | Solow | |
| 4,853,567 | A | 8/1989 | Muramatsu et al. | |
| 4,972,574 | A | 11/1990 | Isono et al. | |
| 5,249,328 | A | 10/1993 | Shin | |
| 5,311,632 | A | 5/1994 | Center | |
| 5,400,466 | A | 3/1995 | Alderman et al. | |
| 5,738,575 | A | 4/1998 | Bock | |
| 5,934,908 | A | 8/1999 | Woog et al. | |
| 5,974,615 | A | 11/1999 | Schwarz-Hartmann et al. | |
| 6,108,853 | A | 8/2000 | Dittus | |
| 6,161,251 | A | 12/2000 | Lee et al. | |
| 6,622,333 | B1 | 9/2003 | Rehkemper et al. | |

* cited by examiner

*Primary Examiner*—Theresa T. Snider
(74) *Attorney, Agent, or Firm*—Amster, Rothstein & Ebenstein LLP

(57) ABSTRACT

A vacuum cleaner nozzle including a nozzle head, the nozzle head including at least one mechanical beater and at least one sonic beater, the at least one sonic beater including a beater portion and an ultrasonic actuating member that vibrates the beater portion.

20 Claims, 10 Drawing Sheets

VACUUM CLEANER NOZZLE INCLUDING MECHANICAL BEATER AND SONIC BEATER

RELATED APPLICATIONS

This application is a continuation-in-part of U.S. patent application Ser. No. 10/871,461, filed Jun. 18, 2004, the disclosure of which is incorporated herein by reference.

FIELD OF THE INVENTION

The present disclosure relates to vacuum cleaners and, more particularly, to vacuum cleaners having beaters that agitate and dislodge dirt from a surface to be cleaned.

BACKGROUND OF THE INVENTION

It is well known in the vacuum cleaner art to provide a suction nozzle which is movable across an object to be cleaned. The suction effect created at an opening in the nozzle results in the removal of free dirt particles accumulated on the object. However, ground in dirt is frequently encountered when cleaning carpets or other textured surfaces, and reliance on simple suction for removal of such ground-in dirt has proven to be unsatisfactory.

Accordingly, effort has been made to provide vacuum cleaners with an effective means to beat the carpet surface to dislodge ingrained dirt particles. Such beaters are often located on the vacuum cleaner nozzle head, so that dirt can be dislodged and instantly removed by simply moving the nozzle head across a soiled carpet surface. The earliest known beaters are mechanical beaters, which physically strike the carpet surface to loosen dirt particles. An example of a mechanical beater is disclosed in U.S. Pat. No. 6,108,853, which includes a cylindrical rotatable beater brush having a plurality of extending resilient bristles and prongs that physically beat the carpet as the nozzle head is moved. U.S. Pat. No. 6,161,251 to Lee et al. uses a mechanical vibration generating device that vibrates using air sucked though a supplementary suction hole to beat the carpet. In various embodiments, the vibration generating device can be used to vibrate the nozzle body which in turn vibrates the surface to be cleaned or the vibration generating device can directly beat the surface.

Later, "sonic beaters" were developed, which rely on fluctuation in air flow through the nozzle opening to dislodge dirt particles. For example, U.S. Pat. No. 2,932,054 to Lichtgarn discloses a vacuum cleaner in which the vibration of disks produces a vibrating column of air that loosens dirt in a carpet. Similarly, U.S. Pat. No. 5,400,466 to Alderman et al. discloses an air vibration suction nozzle that includes a speaker that vibrates the suction air and a means for adjusting the frequency and amplitude of the airwaves produced by the speaker.

Although sonic beaters avoid physical damage to a carpet often caused by mechanical beaters, they are not as effective in dislodging dirt on the surface of a carpet pile. At the same time, mechanical beaters are not as effective in removing particles embedded deeply in the carpet pile. Also, mechanical beaters tend to push dirt particles down into the carpet, thereby making it more difficult to effectively clean the carpet. Accordingly, there is a need for a beater construction that can provide a vacuum cleaner with a more thorough cleaning action.

SUMMARY OF THE INVENTION

One aspect of this invention provides a vacuum cleaner nozzle that allows a vacuum cleaner to exhibit an improved cleaning action.

Another aspect of this invention provides a vacuum cleaner nozzle that allows for an improved cleaning action regardless of the direction in which a user pushes the vacuum cleaner nozzle.

Another aspect of this invention provides a vacuum cleaner nozzle that thoroughly cleans surface fibers and deep fibers of a carpet by effectively dislodging dirt particles at all depths of the carpet pile.

Another aspect of this invention provides a vacuum cleaner nozzle including a mechanical beater that effectively removes imbedded dirt without driving dirt particles deeper into the surface to be cleaned.

A vacuum cleaner nozzle according to an exemplary embodiment of the invention includes a nozzle head, the nozzle head including at least one mechanical beater and at least one sonic beater, the at least one sonic beater including a beater portion and an ultrasonic actuating member that vibrates the beater portion.

A vacuum cleaner according to an exemplary embodiment of the invention includes a dust collecting part and a nozzle connected to the dust collecting part. The nozzle includes a nozzle head, and the nozzle head includes at least one mechanical beater and at least one sonic beater. The at least one sonic beater includes a beater portion and an ultrasonic actuating member that vibrates the beater portion.

In at least on embodiment, the ultrasonic actuating member is an electromagnetic device.

In at least one embodiment, the ultrasonic actuating member includes an electromagnet and a magnet disposed on the beater portion.

In at least one embodiment, the ultrasonic actuating member further includes a solid state device for controlling the electromagnet.

In at least one embodiment, the beater portion is a straight bar.

In at least one embodiment, the straight bar includes bristles.

In at least one embodiment, the at least one sonic beater includes a first sonic beater and a second sonic beater, and the first sonic beater is disposed in front of the at least one mechanical beater and the second sonic beater is disposed behind the at least one mechanical beater.

In at least one embodiment, the ultrasonic actuating member is an electromechanical device.

In at least one embodiment, the ultrasonic actuating member includes a shaft, and at least one eccentric member disposed on the shaft.

In at least one embodiment, the beater portion includes a straight bar, the straight bar being disposed on the shaft.

In at least one embodiment, the at least one mechanical beater includes a rotatable beater brush and a first motor that drives the rotatable beater brush via a drive belt.

In at least one embodiment, the ultrasonic actuating member further includes a rotatable member attached to one end of the shaft, the rotatable member being selectively engaged with the drive belt.

In at least one embodiment, a lever is used to selectively engage the rotatable member with the drive belt.

In at least one embodiment, the ultrasonic actuating member further includes a second motor that drives the shaft.

BRIEF DESCRIPTION OF THE FIGURES

Various exemplary embodiments of this invention will be described in detail, with reference to the following figures, wherein.

DETAILED DESCRIPTION OF PREFERRED EMBODIMENTS

Various exemplary embodiments of the present invention relate to a vacuum cleaner including at least one mechanical beater and at least one sonic beater. For purposes of the present description, the term "sonic beater" refers to a beating mechanism that relies on no or little direct physical contact with the surface to be cleaned to achieve the requisite cleaning action. In various exemplary embodiments of the invention, a sonic beater causes fluctuations in the air flow through a vacuum nozzle to loosen dirt embedded in a soiled surface. In various other exemplary embodiments of the invention, a sonic beater rapidly vibrates while barely contacting the surface to be cleaned to pre-loosen embedded dirt to allow a mechanical beater in the same nozzle head to operate more effectively. A mechanical beater used in conjunction with a sonic beater allows for a more effective cleaning action. For example, when cleaning carpet, the mechanical beater brush helps to loosen dirt located on the upper portion or surface of the carpet's pile while the sonic beater helps to loosen the embedded dirt located in the lower portion of the carpet's pile. Further, the use of both sonic and mechanical beaters can permit the use of softer bristles on a mechanical brush to reduce the wear and tear on the carpet caused by the rotating mechanical brush.

In the present disclosure, like reference numbers refer to like elements throughout the drawings, which illustrate various exemplary embodiments of the invention.

Figure 1:
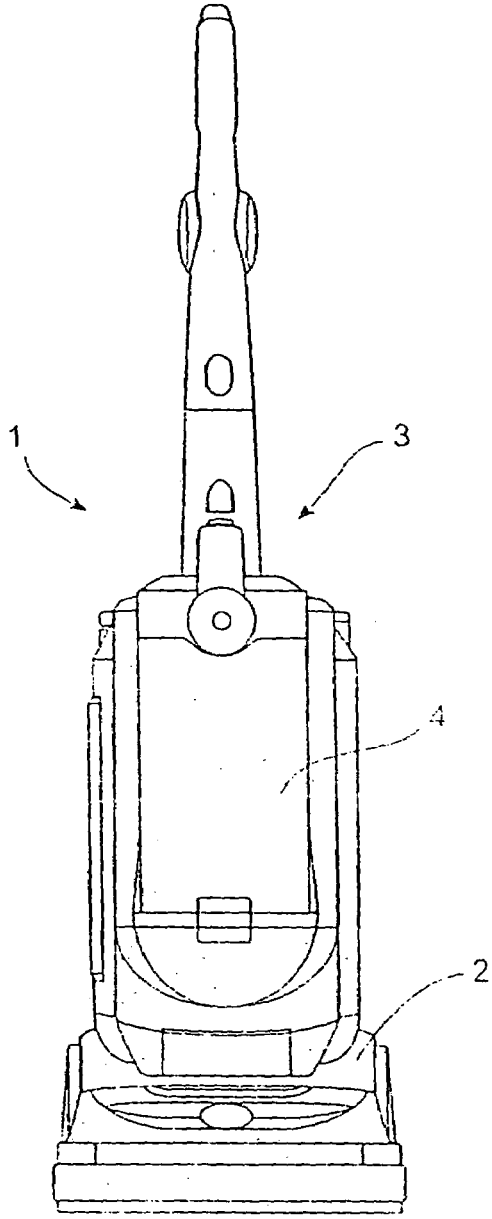
FIG. 1 shows a vacuum cleaner according to an exemplary embodiment of the invention.

FIG. 1 shows generally a vacuum cleaner according to an exemplary embodiment of the present invention. As shown in FIG. 1, the vacuum cleaner 1 includes a nozzle 2, a vacuum cleaner body 3, and a dust collecting part 4. The nozzle 2 may include a motor (not shown) that generates a suction force and which can also be used to actuate various components within the nozzle 2, as described in greater detail below.

Figure 2:
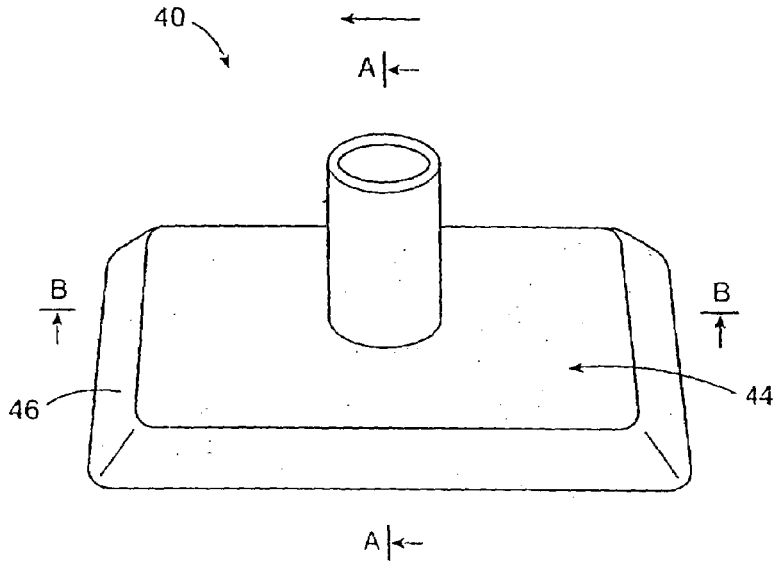
FIG. 2 is a top plan view of a vacuum cleaner nozzle according to an exemplary embodiment of the invention.
Figure 3:
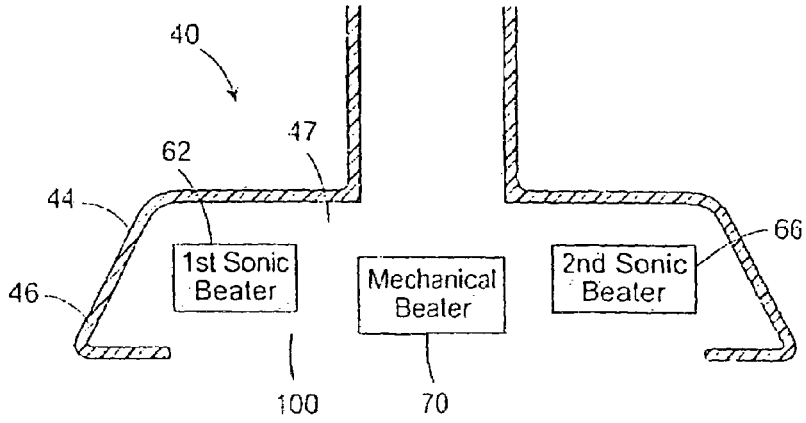
FIG. 3 is a vertical sectional view taken along the line A—A of FIG. 2 illustrating a vacuum cleaner nozzle according to a first exemplary embodiment of the invention.

FIG. 2 illustrates generally a top plan view of the nozzle 40. FIG. 3 is a schematic vertical sectional view taken along the line A—A of FIG. 2 illustrating an exemplary embodiment of the invention.

As shown in FIG. 2, the nozzle 40 includes a nozzle head 44. The nozzle head 44 includes a casing 46 that is cast or molded from any suitable material, such as, for example, plastic. The casing 46 defines a hollow chamber 47 within the nozzle head 44. A nozzle opening 100 is formed in the casing 46 and extends substantially widthwise across the bottom of the casing 46. The nozzle opening 100 is in communication with the chamber 47 defined by the casing 46.

In the present exemplary embodiment of the invention, a first sonic beater 62, a mechanical beater 70 and a second sonic beater 66 are located in the chamber 47 of the nozzle head 44. However, in other exemplary embodiments, the nozzle head 44 can include any suitable number of sonic beaters and mechanical beaters so that the nozzle head 44 is able to dislodge and remove dirt embedded within the surface to be cleaned. Preferably, as shown in FIG. 3, the first sonic beater 62 is located at the front portion of the nozzle head 44 in front of the mechanical beater 70 and the nozzle opening 100, and the second sonic beater 66 is located in the back portion of the nozzle head 44 behind the mechanical beater 70 and the nozzle opening 100. Such an arrangement of the beaters allows the vacuum 1 to effectively loosen and suck up embedded dirt regardless of the direction of movement of the nozzle 40. However, other embodiments of the invention can include any suitable arrangement of sonic and mechanical beaters. In the exemplary embodiment shown in FIG. 3, any known or later discovered mechanical and sonic beaters can be incorporated into the nozzle head structure.

The following exemplary embodiments are provided to illustrate in more detail the various types of mechanical and sonic beater structures that can be used in the present invention, and are not meant to limit in any way the type or arrangement of such beaters.

Figure 4:
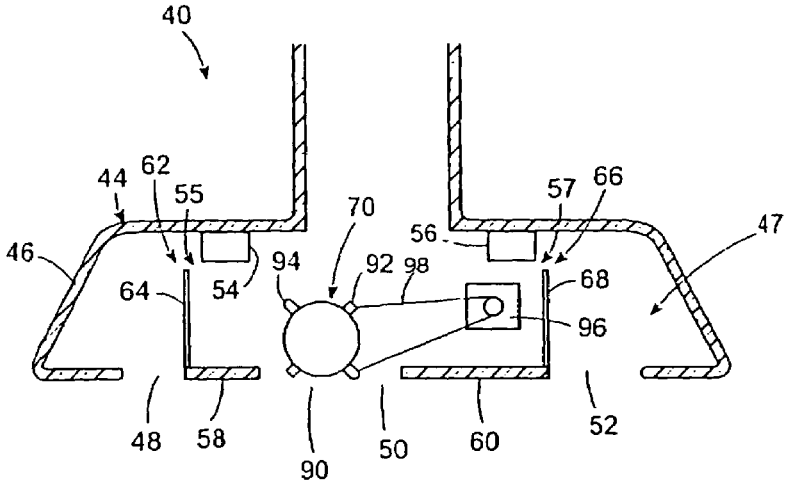
FIG. 4 is a vertical sectional view taken along the line A—A of FIG. 2 illustrating a vacuum cleaner nozzle according to a second exemplary embodiment of the invention.

FIG. 4 is a vertical sectional view taken along the line A—A of FIG. 2 according to an exemplary embodiment of the invention.

As shown in FIG. 4, a first opening 48, a second opening 50 and a third opening 52 are formed in the casing 46 each extending substantially widthwise across the bottom of the casing 46. The first opening 48, second opening 50 and third opening 52 are in communication with the chamber 47 defined by the casing 46. In the present embodiment of the invention, the first opening 48, the second opening 50 and the third opening 52 form a first nozzle opening, a second nozzle opening and a third nozzle opening, respectively. A first crosspiece 58 extends between the first opening 48 and the second opening 50, and a second crosspiece 60 extends between the second opening 50 and the third opening 52. A first extending portion 54 is formed at the front portion of the nozzle head 40 and extends from the bottom surface of the upper portion of the casing 46. A second extending portion 56 is formed at the back portion of the nozzle head 44 and extends from the bottom surface of the upper portion of the casing 46. The first extending portion 54 and the second extending portion 56 form a first narrowed portion 55 and second narrowed portion 57, respectively, of the chamber 47.

In the present exemplary embodiment of the invention, a first sonic beater 62, a mechanical beater 70 and a second sonic beater 66 are located in the chamber 47 of the nozzle head 44. Preferably, as shown in FIG. 4, the first sonic beater 62 is located at the front portion of the nozzle head 44 in front of the mechanical beater 70 and the second sonic beater 66 is located in the back portion of the nozzle head 44 behind the mechanical beater 70. Such an arrangement of the beaters allows the vacuum 1 to effectively loosen and suck up embedded dirt regardless of the direction of movement of the nozzle 40.

The first sonic beater 62 includes a first vibrator 64 disposed on the first crosspiece 58 transverse to the first nozzle opening 48 and proximate and in front of the first narrowed portion 55 of the chamber 47. The first vibrator 64 is preferably made of a flexible material, such as, for example, rubber. The operation of the first sonic beater is such that there is no physical striking of the carpet surface to dislodge ground-in dirt particles. Rather, when the vacuum motor is energized, the air stream flowing over the top of the first vibrator 64 causes it to move as indicated by the dash lines in FIG. 5. Preferably, the first vibrator 64 closely matches in contour and size the first narrowed portion 55 of the chamber 47. The cross-sectional areas of the first narrowed portion 55 and the second narrowed portion 57 are much reduced in comparison to other portions of the chamber 47. As a consequence of the close matching of the first vibrator 64 with the first narrowed portion 55, the movement of the first vibrator 64 alternately decreases and increases the size of the passage between the first narrowed portion 55 and the first nozzle opening 48. This causes the suction pressure to alternately rise and fall while at the same time, and as a direct result, the velocity of air flow increases and decreases alternately and in rapid succession. The free end of the first vibrator 64 snaps back and forth in the manner of a "cracking whip", thus making the changes in air pressure and air velocity extremely abrupt. The vibratory air zone or column passing through the first nozzle opening 48 as a result of the movement of the first vibrator 64 dislodges and shakes the dirt loose within the effective suction area of the vacuum 1, so that as the dirt is loosened, it can be carried off by the suction.

The second sonic beater 66 includes a second vibrator 68 disposed on the second crosspiece 60 transverse to the third nozzle opening 48 and proximate and behind the second narrowed portion 57 of the chamber 47. The second sonic beater 66 operates substantially the same as the first sonic beater 62 to loosen and remove embedded dirt.

The mechanical beater 70 is disposed between the first sonic beater 62 and the second sonic beater 66. In the present exemplary embodiment of the invention, the mechanical beater 70 includes a conventional rotatable beater brush structure 90 rotatably mounted to the casing 46. A drive motor 96 is mounted on the casing 46 behind the rotatable beater brush structure 90. The drive motor 96 generates power to drive the rotatable beater brush structure 90 via a belt 98 that connects drive motor 96 to the rotatable beater brush structure 90. As well known in the art, the rotatable beater brush structure 90 is a cylindrically shaped roller that carries a plurality of brush strips 92 and beater strips 94. Each brush strip 92 includes a plurality of brush bundles (not shown) spaced apart from each other for agitating the surface being cleaned upon rotation of the beater brush structure 90. Each beater strip 94 includes a plurality of relatively rigid projections (not shown) which become engaged with the surface being cleaned upon rotation of the beater brush structure 90.

As described above, the first sonic beater 62, the mechanical beater 70 and the second sonic beater 66 of the nozzle head 44 work in conjunction to dislodge and remove dirt as the nozzle head 44 is moved across a soiled surface in a back and forth motion. For example, as the nozzle head 44 is moved forwards and backwards across a carpet, the first sonic beater 62 helps first to loosen dirt embedded deeply in the carpet's pile, then the mechanical beater dislodges dirt on the upper portion or surface of the carpet's pile, allowing for a more thorough cleaning action. It should be appreciated that the detailed descriptions of the sonic and mechanical beaters are provided in this disclosure merely as exemplary structure, and one having ordinary skill in the art would understand that any suitable type of mechanical and sonic beaters can be incorporated into a nozzle head to form various other exemplary embodiments of the invention. As discussed, it is a combination of both a mechanical beater and a sonic beater that provides a vacuum cleaner according to preferred embodiments of this invention with an improved cleaning action.

Figure 5:
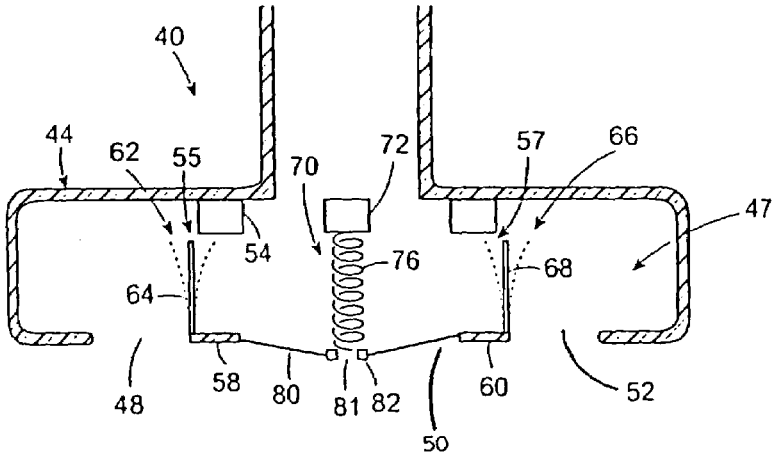
FIG. 5 is a vertical sectional view taken along line A—A of FIG. 2 illustrating a vacuum cleaner nozzle according to a third exemplary embodiment of the invention.
Figure 6:
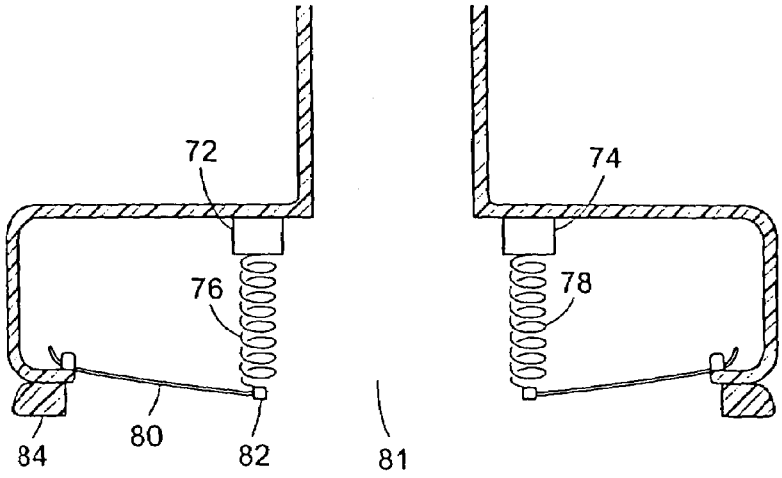
FIG. 6 is a vertical sectional view taken along line B—B of FIG. 2 illustrating the vacuum cleaner nozzle according to the third exemplary embodiment of the invention.
Figure 7:
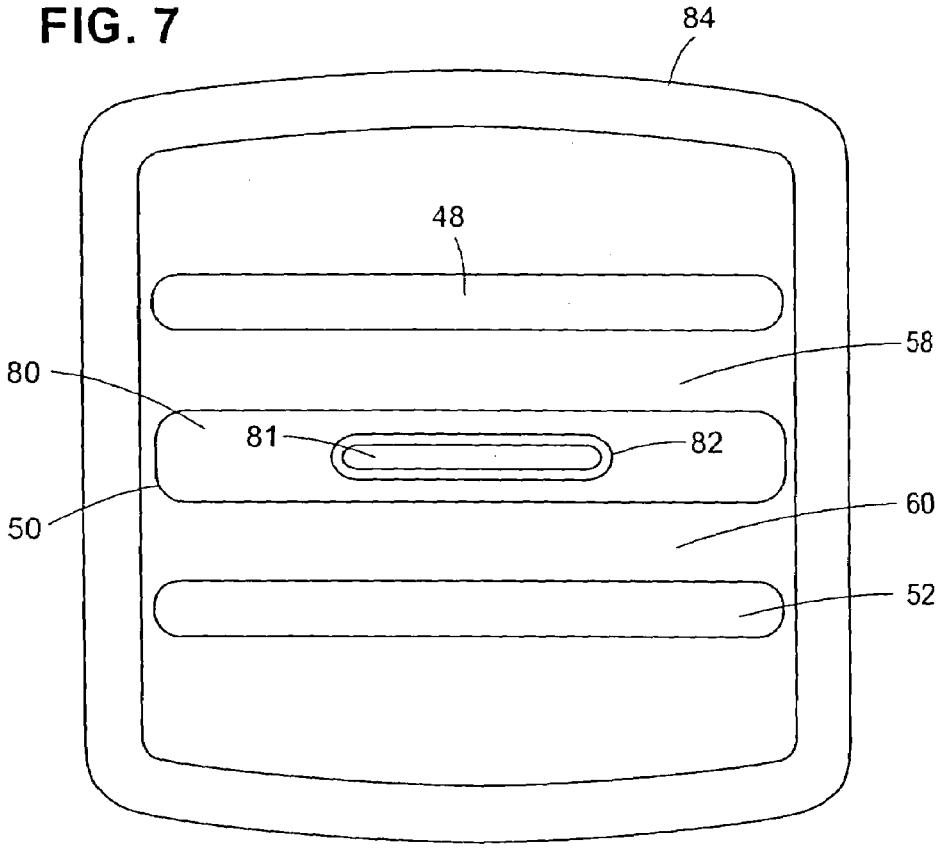
FIG. 7 is a bottom plan view of the vacuum cleaner nozzle according to the third exemplary embodiment of the invention.

FIGS. 5–7 illustrate a vacuum nozzle structure according to another exemplary embodiment of the invention. FIG. 5 is a vertical sectional view taken along the line A—A of FIG. 2, FIG. 6 is a vertical sectional view taken along the line B—B of FIG. 2, and FIG. 7 is a bottom plan view of the nozzle 40.

The present embodiment of the invention is substantially the same as the previous embodiment except for the structure of the mechanical beater 70. As in the previous embodiment, a first opening 48, a second opening 50 and a third opening 52 are formed in the casing 46 each extending substantially widthwise across the bottom of the casing 46. The first opening 48, second opening 50 and third opening 52 are in communication with the chamber 47 defined by the casing 46. The first opening 48 and the third opening 52 form a first nozzle opening and a second nozzle opening, respectively. Also, similar to the previous embodiment of the invention, a first sonic beater 62, a mechanical beater 70 and a second sonic beater 66 are located in the chamber 47 of the nozzle head 44. The first sonic beater 62 includes a first vibrator 64 disposed on the first crosspiece 58 transverse to the first nozzle opening 48 and proximate and in front of the first narrowed portion 55 of the chamber 47. The second sonic beater 66 includes a second vibrator 68 disposed on the second crosspiece 60 transverse to the third nozzle opening 48 and proximate and behind the second narrowed portion 57 of the chamber 47.

The mechanical beater 70 is disposed between the first sonic beater 62 and the second sonic beater 66. As shown in FIGS 5–6 the mechanical beater 70 according to the present embodiment of the invention includes a diaphragm 80, a first compression spring 76 and a second compression spring 78. The diaphragm 80 extends across the second opening 50 in the nozzle head 44 from the inner end of the first crosspiece 58 to the inner end of the second crosspiece 60. The diaphragm 80 is preferably formed of a flexible material, such as, for example, rubber or plastic. As best shown in FIG. 7, the diaphragm 80 has an opening 81 extending substantially widthwise across the nozzle head 44 and located at the central area of the diaphragm 80. The opening 81 forms a second nozzle opening. The edges of the second nozzle opening 81 are preferably reinforced by a metal or plastic rim 82 secured to the diaphragm in any suitable manner, such as by rivets.

As shown in FIG. 6, the upper ends of the first compression spring 76 and the second compression spring 78 are anchored to a first spring support 72 and a second spring support 74, respectively, which extend from the lower surface of an upper portion of the casing 46. The lower ends of the first compression spring 76 and the second compression spring 78 are fixed to the rim 82 at opposite ends of the second nozzle opening 81. The operation of the mechanical beater 70 is described below.

When the suction motor is energized, since the rim 82 surrounding the second nozzle opening 81 is held sealed against the carpet by first and second springs 76 and 78, the suction produced in chamber 47 becomes effective to lift the diaphragm 80 in opposition to the first and second springs 76 and 78 as a consequence of the higher air pressure acting on the lower face of the diaphragm. A downwardly extending skid 84 disposed on the outer bottom surface of the casing 46 prevents the diaphragm 80 from sealing to the carpet at its outer edges. The air gap between the skid 84 and the rim 82 ensures that the lower face of the diaphragm 80 will be open to the atmosphere to maintain a pressure differential across the diaphragm 80. The diaphragm 80 rises and leaves the carpet to break the seal between the carpet and the rim 82 allowing atmospheric air to rapidly enter second nozzle opening 81. As a result, the air pressure within chamber 47 sharply increases, which, along with the energy stored in the first and second springs 72 and 74, causes the diaphragm 80 to snap downwardly, bringing the rim 82 into abrupt contact with the carpet. The diaphragm 80 cycles rapidly and with great force due to the alternately increasing and decreasing pressure differential acting on the opposing faces of the diaphragm 80. As a result, the rim 82 attached to the diaphragm 80 rapidly beats the carpet to dislodge dirt which is immediately sucked into the second nozzle opening 81.

Figure 8:
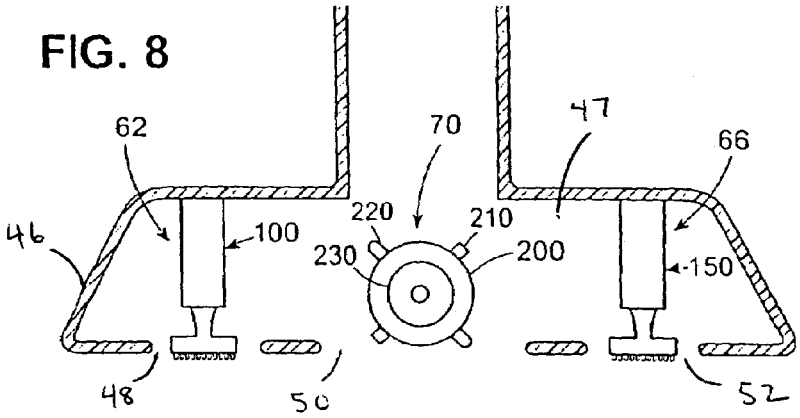
FIG. 8 is a vertical sectional view taken along line A—A of FIG. 2 illustrating a vacuum cleaner nozzle according to a fourth exemplary embodiment of the invention.
Figure 9:
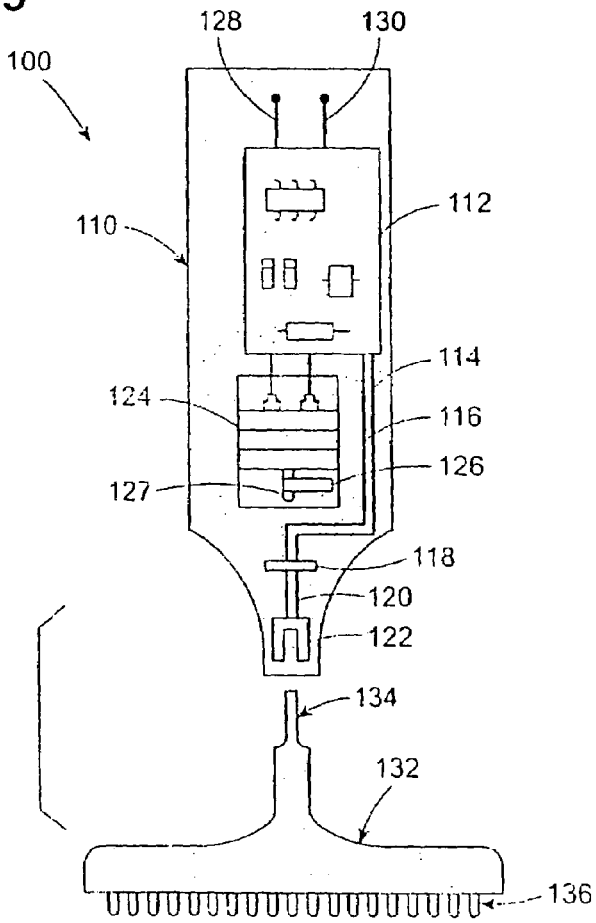
FIG. 9 is a vertical sectional view of the ultrasonic agitator 100 of FIG. 8.
Figure 10:
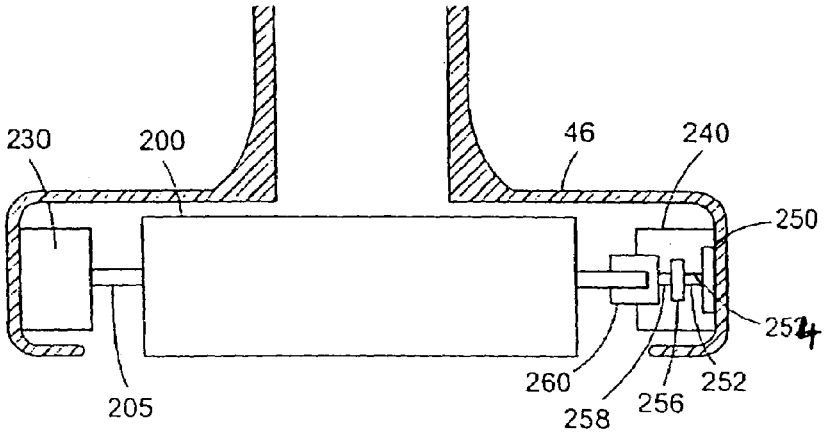
FIG. 10 is a vertical sectional view taken along line B—B of FIG. 2 illustrating the vacuum cleaner nozzle according to the fourth exemplary embodiment of the invention.

FIGS. 8 and 9 illustrate a vacuum nozzle structure according to another exemplary embodiment of the invention. FIG. 8 is a vertical sectional view taken along the line A—A of FIG. 2, and FIG. 9 is a vertical sectional view taken along the line B—B of FIG. 2.

In the present embodiment of the invention, the first sonic beater 62 and second sonic beater 66 include ultrasonic beating mechanisms that contact and vibrate the surface to be cleaned at a rapid rate to pre-loosen ground in dirt so as to enhance the effectiveness of the mechanical beater 70. As in the previous embodiments, a first opening 48, a second opening 50 and a third opening 52 are formed in the casing 46 each extending substantially widthwise across the bottom of the casing 46. The first opening 48, second opening 50 and third opening 52 are in communication with the chamber 47 defined by the casing 46. The first opening 48, second opening 50 and third opening 52 form a first nozzle opening, a second nozzle opening and a third nozzle opening, respectively. Also, similar to the previous embodiment of the invention, a first sonic beater 62, a mechanical beater 70 and a second sonic beater 66 are located in the chamber 47 of the nozzle head 44. The first sonic beater 62 includes a first ultrasonic agitator 100 fixedly disposed on the lower surface of the upper portion of the nozzle head 44 above the first nozzle opening 48. The second sonic beater 66 includes a second ultrasonic agitator 150 fixedly disposed on the lower surface of the upper portion of the nozzle head 44 above the third nozzle opening 52. A more detailed description of the structure and operation of the ultrasonic agitators 100 and 150 according to the present embodiment of the invention is provided below.

As shown in FIG. 9, the first ultrasonic agitator 100 includes an ultrasonic actuating member 110 and a brush head 132. The brush head 132 includes a bristled end 136. The brush head 132 is set at a predetermined level so that the bristled end 136 will barely contact the surface to be cleaned while the vacuum cleaner 1 is in operation. The ultrasonic actuating member 110 includes an electric motor 124 to which is attached an eccentrically mounted member 126 via a rotatable shaft 127. The electric motor 124 is connected to a power source (not shown) via electrical conductors 128 and 130. When the vacuum cleaner 1 is turned on, the electric motor 124 will rotate eccentric member 126 and the entire ultrasonic agitator 100 will vibrate in a rotary direction. Because the ultrasonic actuating member 110 is fixed to the nozzle head 44 and the mass of the ultrasonic actuating member 110 is much greater than that of the brush head 132, the bristled end 136 of the brush head 132 will vibrate about a greater radius than that of the ultrasonic actuating member 110. Thus, the bristled end 136 will rotate at a rapid rate.

Also connected to the power source is an electronic circuit package 112 that produces high frequency oscillations which are coupled via lines 114 and 116 to an sonic transducer 118. The transducer 118 is in turn mechanically coupled via connector 120 to a holder 122 which is adapted to surround and frictionally secure within it an extension 134 of the brush head 132. The sonic transducer 118 is preferably a commercially available device capable of producing a sonic wave in the frequency range of, for example, 10–20 MHz. The energy is coupled directly from the transducer 118 through the connector 120 which acts as a wave guide and into holder 122 from which it propagates into the brush head 132. Thus, the bristled end 136 of the brush head 132 vibrates while being caused to rotate by the rotating eccentric member 126. If the sonic transducer 118 causes the bristled end 136 to vibrate at a frequency larger than 20,000 Hz, the bristled end 136 may be said to be vibrating "ultrasonically", in which case the first sonic beater 62 may be referred to as an ultrasonic beater. This rapid motion of the brush head 132 agitates the dirt embedded in the surface to be cleaned, and therefore pre-loosens the dirt before the mechanical beater 70 passes over the surface. The mechanical beater 70 is then able to more effectively suck up the loosened dirt by a sweeping action. Also, because the bristled end 136 of the brush head 132 barely contacts the surface, the brush head 132 is able to agitate the dirt without grounding the dirt into the carpet.

The second ultrasonic agitator 150 of the second sonic beater 66 operates substantially the same as the first ultrasonic agitator 100 to pre-loosen ground in dirt so that the mechanical beater 70 will function more effectively.

In the present embodiment of the invention, the ultrasonic agitators are not limited to a brush head having a bristled end. Any suitable structure, such as, for example, a roller or a straight bar that can be ultrasonically actuated to agitate the carpet to pre-loosen dirt embedded in the carpet can be used.

The mechanical beater 70 of the present embodiment of the invention includes a generally cylindrical beater brush 200 that carries a plurality of brush strips 210 and a plurality of beater strips 220. A direct drive motor 230 drives the beater brush 200. As is generally known in the motor art, a direct drive motor drives a device or machine that is directly connected mechanically to the driving shaft of the motor without the use of belts or chains. Such a direct drive motor is characterized by its high resolution, high speed and dust-proof structure. The direct drive motor 230 is mounted in the casing 46 and rotatably drives the beater brush 200 via a drive axle 205. Each brush strip 210 includes a plurality of brush bundles (not shown) spaced apart from each other for agitating the surface being cleaned upon rotation of the beater brush 200 by the direct drive motor 230. Each beater strip 220 includes a plurality of rigid projections (not shown) which contact and in some cases engage with the surface being cleaned upon rotation of the beater brush 200.

As shown in FIG. 910, the drive axle 205 is also engaged with an ultrasonic agitator 240. The ultrasonic agitator 240 is mounted to the casing 46 and is operatively attached to the drive axle 205 opposite the direct drive motor 230. The ultrasonic agitator 240 includes an electronic circuit package 250 that produces high frequency oscillations which are coupled via lines 252 and 254 to an ultrasonic transducer 256. The transducer 256 is in turn mechanically coupled via connector 258 to a holder 260 which is adapted to surround and frictionally secure within it the drive axle 205. Thus, the ultrasonic waves caused by the transducer 256 are imparted to the drive axle 205, which in turn causes the cylindrical beater brush 200 to rapidly vibrate while rolling over the surface to be cleaned. This enhances the effectiveness of the beater brush 200 by allowing it to agitate and loosen embedded dirt without pushing the dirt further into the carpet. Thus, in the present embodiment of the invention, the overall cleaning ability of the nozzle head 44 in loosening and removing embedded dirt is improved by the use of both ultrasonic agitators 100, 150 and a vibrating cylindrical beater brush 200.

Figure 11:
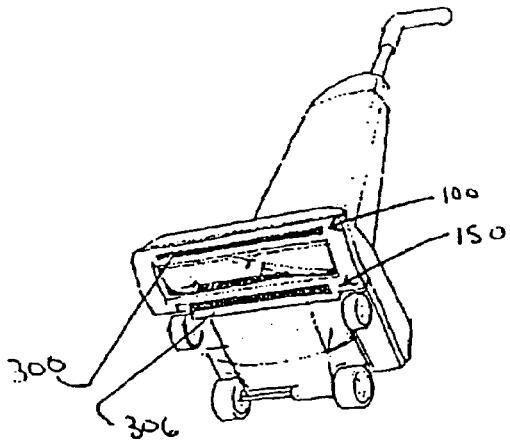
FIG. 11 is a perspective view of a vacuum cleaner according to an exemplary embodiment of the invention.
Figure 12:
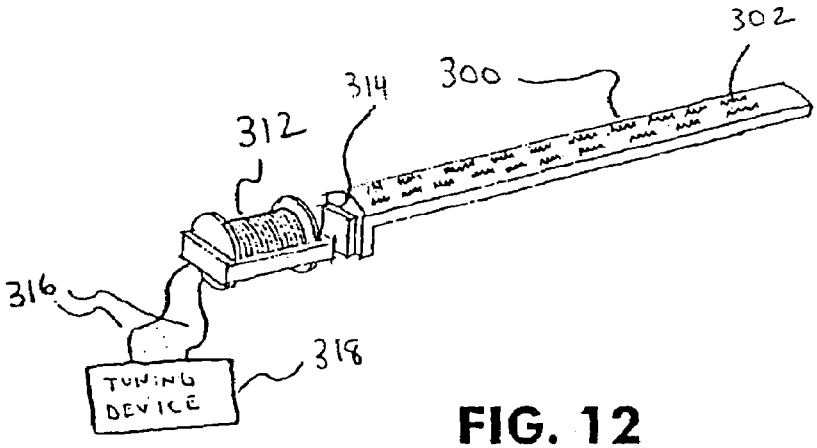
FIG. 12 is a perspective view of a sonic beater according to an exemplary embodiment of the invention.

As mentioned previously, the structure of the ultrasonic agitator used in exemplary embodiments of the present invention is not limited to that described herein. FIG. 11, for example, shows ultrasonic agitators 100 and 150 each including a corresponding straight bar 300, 306 that beats the carpet at high speeds. As shown in FIG. 12, each straight bar 300, 306 may include bristles 302 that extend towards the surface to be cleaned. The bristles 302 may be arranged in any suitable pattern and may be made of any suitable material, such as, for example, nylon and rubber. The bristles 302 allow the straight bars 300, 306 to beat the carpet more effectively by bridging any gap between the straight bars 300, 306 and the carpet. Each of the straight bars 300, 306 may be sonically agitated by an electromagnetic actuator, such as that illustrated in FIG. 12. In particular, the electromagnetic actuator includes an electromagnet 312 that changes polarity at high frequencies to vibrate an adjacent tool magnet 314 disposed on the straight bar 300. The tool magnet 314 in turn imparts vibration to the straight bar 300. The electromagnet 312 is connected by wires 316 to a solid-state tuning device 318, which may be used to adjust the frequency of vibration of the straight bar 300. The solid-state tuning device 318 may be disposed on the outer surface of the casing 46 for easy access by a user. An electromagnetic actuator having the same structure as that described above may be used to vibrate the straight bar 306.

Figure 13:
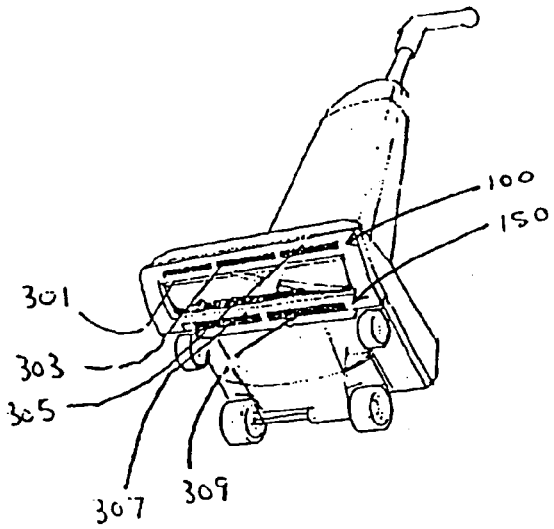
FIG. 13 is a perspective view of a vacuum cleaner according to another exemplary embodiment of the invention.

The end of the straight bar 300, 306 opposite to the end on which the tool magnet 314 is disposed is preferably fixed to the casing 46. Thus, the vibration intensity along the straight bar 300, 306 diminishes with increased distance from the tool magnet 314. This may cause the vacuum cleaner to exhibit better cleaning performance along one side of a cleaning path than at another side. To counteract this effect, in other embodiments of the invention, a plurality of straight bars may be disposed within each of the openings 48 and 52 illustrated in previous figures. For example, as shown in FIG. 13, three straight bars 301, 303 and 305 may be disposed within the opening 48 and two straight bars 307 and 309 may be disposed within the opening 52. Each straight bar 301, 303, 305, 307, and 309 may be independently actuated by a corresponding electromagnetic actuator so that the carpet is vibrated evenly across a cleaning path and the vacuum nozzle exhibits a balanced cleaning action. In other embodiments of the invention, any number of straight bars may be disposed within openings 48 and 52.

Figure 14:
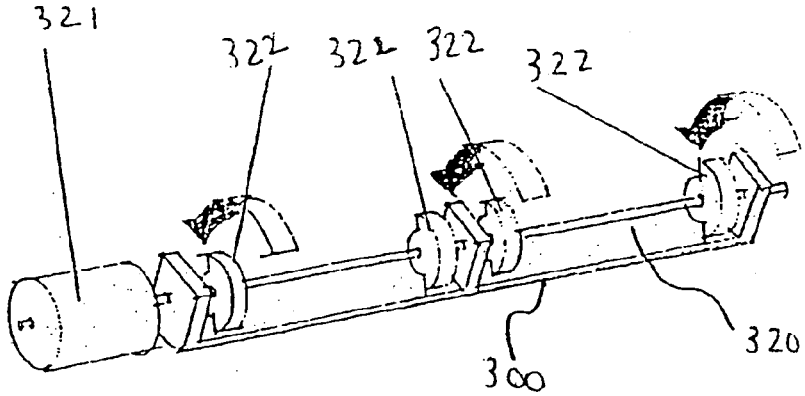
FIG. 14 is a perspective view of a sonic beater according to another exemplary embodiment of the invention.

In another embodiment of the invention, the straight bar 300, 306 may be disposed on a shaft 320, as shown in FIG. 14. An eccentric member 322 may also be disposed on the shaft 320 and the shaft 320 may be turned by a motor 321. While turning, the eccentric member 322 causes the shaft 320 to vibrate, which in turn causes the straight bar 300 to vibrate and sonically agitate the carpet. A switch may be disposed on the nozzle head to turn the motor 321 on and off. As shown in FIG. 14, a plurality of eccentric members 322 may be disposed along the shaft 320. Although four eccentric members 322 are shown in FIG. 14, the shaft 320 may include any number of eccentric members 322 depending on the desired intensity of vibration.

Figure 15:
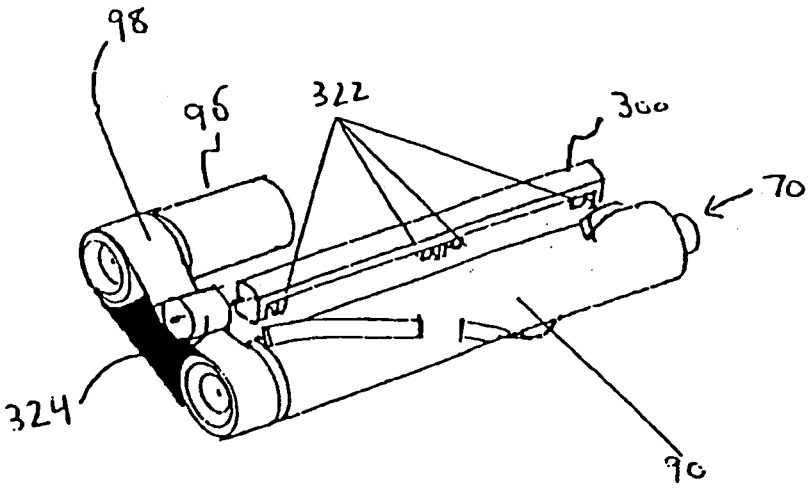
FIG. 15 is a perspective view of a sonic beater and mechanical beater according to an exemplary embodiment of the invention.
Figure 16:
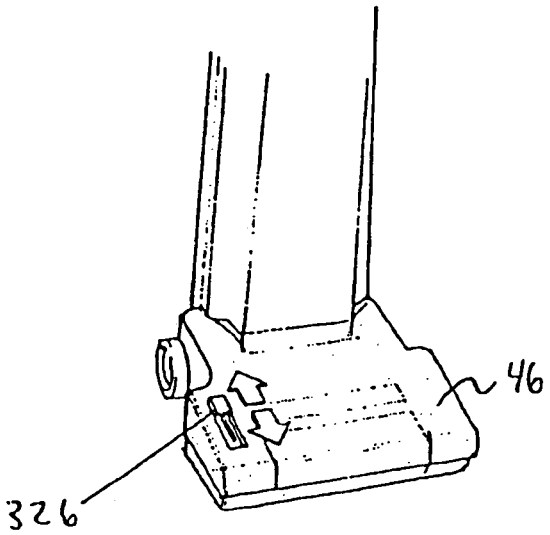
FIG. 16 is a perspective view of a vacuum cleaner according to another exemplary embodiment of the invention.
Figure 17:
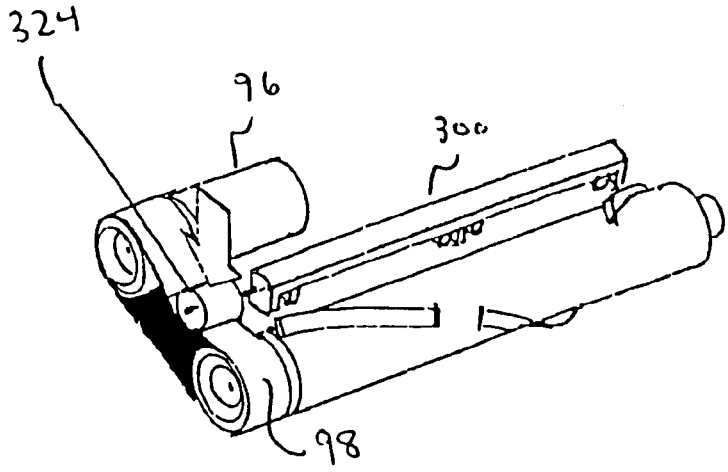
FIG. 17 shows the sonic beater of FIG. 15 in the "on" position.
Figure 18:
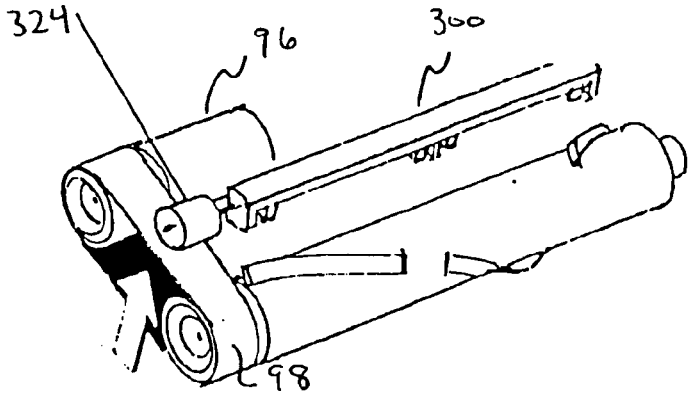
FIG. 18 shows the sonic beater of FIG. 15 in the "off" position.

Alternatively, the shaft 320 may be actuated by the same motor which drives the mechanical beater. For example, as shown in FIG. 15, the nozzle head may include the same mechanical beater assembly as in the embodiment illustrated in FIG. 4. That is, the mechanical beater 70 includes a conventional rotatable beater brush structure 90 driven by a drive motor 96 via a belt 98. As is well known in the art, the rotatable beater brush structure 90 is a cylindrically shaped roller that carries a plurality of brush strips and beater strips. In the present embodiment, a rotating member 324 is disposed at one end of the shaft 320. When rotating member 324 is in contact with the belt 98 and the drive motor 96 is actuated, the shaft 320 is caused to rotate. Thus, instead of being directly driven by a separate motor, as in the previous embodiment, the shaft 320 in the present embodiment of the invention is driven by the same motor which drives the mechanical beater 70. As shown in FIG. 16, the straight bar 300 may be activated and deactivated with the use of a lever 326 disposed on the casing 46. When disposed in the "on" position, the lever 326 causes the rotating member 324 to engage with the belt 98, as shown in FIG. 17, thereby causing the straight bar 300 to vibrate. When disposed in the "off" position, the lever 326 causes the rotating member 324 to disengage with the belt 98, as shown in FIG. 18.

The ultrasonic agitators are not limited to the structures shown and described in the above embodiments, and any known or later discovered devices that impart sonic vibrations to the various beaters of the nozzle head to agitate and loosen embedded dirt can be used. Further, in other embodiments of the invention, sonic vibrations can be imparted to only the mechanical beater, so that the sonic beaters rapidly rotate without vibrating. In still other embodiments of the invention, sonic vibrations can be imparted to only the sonic beaters, and conventional mechanical beaters without sonic vibrations can be used. Also, in other exemplary embodiments of the invention, the sonic beaters can be caused to vibrate without rotation, so that a separate electric motor to actuate such rotation is not required. The present invention is intended to encompass any combination of mechanical and sonic beaters in a nozzle head of a vacuum cleaner, where the mechanical beaters and/or the sonic beaters are caused to sonically agitate the surface to be cleaned.

While the foregoing invention has been described in some detail for purposes of clarity and understanding, it will be appreciated by one skilled in the art from a reading of the disclosure that various changes in form and detail can be made without departing from the true scope of the invention in the appended claims.

What is claimed is:

1. A vacuum cleaner nozzle comprising:

a nozzle head, the nozzle head comprising at least one mechanical beater and at least one sonic beater, the at least one sonic beater comprising a beater portion and an actuating member that vibrates the beater portion, the actuating member being an electromagnetic device comprising an electromagnet and a magnet disposed on the beater portion.

2. The vacuum cleaner nozzle of claim 1, wherein the actuating member further comprises a solid state device for controlling the electromagnet.

3. The vacuum cleaner nozzle of claim 1, wherein the beater portion comprises a straight bar.

4. The vacuum cleaner nozzle of claim 3, wherein the straight bar comprises bristles.

5. The vacuum cleaner nozzle of claim 1, wherein the at least one sonic beater comprises a first sonic beater and a second sonic beater, and the first sonic beater is disposed in front of the at least one mechanical beater and the second sonic beater is disposed behind the at least one mechanical beater.

6. A vacuum cleaner nozzle comprising:

a nozzle head, the nozzle head comprising at least one mechanical beater and at least one sonic beater, the at least one sonic beater comprising a beater portion and an actuating member that vibrates the beater portion, the actuating member being an electromechanical device comprising a shaft and at least one eccentric member disposed on the shaft, the beater portion comprising a straight bar, the straight bar being disposed on the shaft.

7. The vacuum cleaner nozzle of claim 6, wherein the at least one mechanical beater comprises a rotatable beater brush and a first motor that drives the rotatable beater brush via a drive belt.

8. The vacuum cleaner nozzle of claim 7, wherein the actuating member further comprises a rotatable member attached to one end of the shaft, the rotatable member being selectively engaged with the drive belt.

9. The vacuum cleaner nozzle of claim 8, further comprising a lever for selectively engaging the rotatable member with the drive belt.

10. The vacuum cleaner nozzle of claim 7, wherein the actuating member further comprises a second motor that drives the shaft.

11. A vacuum cleaner comprising:

a dust collecting part;

a nozzle connected to the dust collecting part, the nozzle comprising a nozzle head, the nozzle head comprising at least one mechanical beater and at least one sonic beater, the at least one sonic beater comprising a beater portion and an actuating member that vibrates the beater portion, the actuating member being an electromagnetic device comprising an electromagnet and a magnet disposed on the beater portion.

12. The vacuum cleaner of claim 11, wherein the actuating member further comprises a solid state device for controlling the electromagnet.

13. The vacuum cleaner of claim 11, wherein the beater portion comprises a straight bar.

14. The vacuum cleaner of claim 13, wherein the straight bar comprises bristles.

15. The vacuum cleaner of claim 11, wherein the at least one sonic beater comprises a first sonic beater and a second sonic beater, and the first sonic beater is disposed in front of the at least one mechanical beater and the second sonic beater is disposed behind the at least one mechanical beater.

16. A vacuum cleaner comprising:

a dust collecting part;

a nozzle connected to the dust collecting part, the nozzle comprising a nozzle head, the nozzle head comprising at least one mechanical beater and at least one sonic beater, the at least one sonic beater comprising a beater portion and an actuating member that vibrates the beater portion, actuating member being an electromechanical device comprising a shaft and at least one eccentric member disposed on the shaft, the beater portion comprising a straight bar, the straight bar being disposed on the shaft.

17. The vacuum cleaner of claim 16, wherein the at least one mechanical beater comprises a rotatable beater brush and a first motor that drives the rotatable beater brush via a drive belt.

18. The vacuum cleaner of claim 17, wherein the actuating member further comprises a rotatable member attached to one end of the shaft, the rotatable member being selectively engaged with the drive belt.

19. The vacuum cleaner of claim 18, further comprising a lever for selectively engaging the rotatable member with the drive belt.

20. The vacuum cleaner of claim 17, wherein the actuating member further comprises a second motor that drives the shaft.

* * * * *